US005803180A

United States Patent [19]

Talley

[11] Patent Number: 5,803,180

[45] Date of Patent: Sep. 8, 1998

[54] CORROSION AND SLUDGE PREVENTION IN AUTOMATIC SPRINKLER-FIRE PROTECTION SYSTEMS

[76] Inventor: Roger K. Talley, 918 Tenderfoot Hill Rd., Suite #002, Colorado Springs, Colo. 80906

[21] Appl. No.: 610,473

[22] Filed: Mar. 4, 1996

[51] Int. Cl.[6] ..... A62C 35/58

[52] U.S. Cl. ..... 169/16; 169/37

[58] Field of Search ..... 169/37, 16; 285/329

[56] References Cited

U.S. PATENT DOCUMENTS

| | | | |
|---|---|---|---|
| 3,939,914 | 2/1976 | Carroll | 169/16 |
| 4,215,751 | 8/1980 | Mears | 169/37 |
| 4,220,208 | 9/1980 | Jackson et al. | 169/37 |
| 4,708,814 | 11/1987 | Stewart | 252/181 |
| 4,834,186 | 5/1989 | Ballard | 169/37 |
| 5,109,929 | 5/1992 | Spears | 169/37 |
| 5,169,180 | 12/1992 | Villoni et al. | 285/329 |

OTHER PUBLICATIONS

Baumeister, Theodore, "Mechanical Engineers' Handbook," McGraw–Hill Book Company, pp. 6–123, 6–127, Dec. 1958.

*Primary Examiner*—Gary C. Hoge
*Attorney, Agent, or Firm*—Bush, Riddle & Jackson

[57] ABSTRACT

A structure and method for ensuring the continuing operability of a fire protection sprinkler system that includes the addition to the water in the piping of a chemical compound that adjusts the Ph level to a value between 9.5 and 11 to prevent electro-chemical corrosion and formation of sludge by surface reducing bacteria, and the use of a non-conductive fitting between each sprinkler head and the piping to prevent galvanic corrosion due to contact between dissimilar metals.

5 Claims, No Drawings

CORROSION AND SLUDGE PREVENTION IN AUTOMATIC SPRINKLER-FIRE PROTECTION SYSTEMS

FIELD OF THE INVENTION

This invention relates generally to methods and means for preventing corrosion and sludge build-up in water-filled automatic sprinkler systems, and particularly to the addition of a chemical compound to adjust the pH level of the water to a certain range, and the use of dielectric couplings at the sprinkler heads, to prevent galvanic corrosion, which also inhibits sludge build-up that otherwise can make a fire extinguishing system inoperable when needed.

BACKGROUND OF THE INVENTION

Fire protection systems that use water filled piping, tees and sprinkler heads are used extensively in a wide variety of structures such as public institutional buildings, warehouses, manufacturing plants, government and private offices (particularly those with large inventories of high technology electronic business equipment), many retail and business establishments, and more recently in private homes that are located in areas subject to frequent brush or forest fires. Virtually all such automatic sprinkler systems are of the water filled type and are designed, specified, fabricated and installed in accordance with well developed and proven standards and codes established by the National Fire Protection Association. The piping manifolds are fabricated of Schedule 10 or 40 steel tubes, are rated at 300 psi and are grooved near each joint end to accommodate compression rubber ring-style mechanical couplings which join the ends of pipejoints. One-half (½) to three-quarter (¾) inch tees made of black iron are threaded onto the pipe at prescribed spacings to feed water to bronze sprinkler heads. The connection of a tee to a sprinkler head is made by a male threaded nipple which connects to female threads in the tee and the head. Teflon or other suitable plumbers tape is used to seal these connections. Typically, and essentially without exception, no liner or non-metallic high dielectric coating is installed in the inside of the pipes or service tees to act as a barrier at the water-pipe interface. No attempt is made to electrically separate the galvanic couple established between the bronze sprinkler head and the threads and body of the black iron tee. The tape acts as a waterproof seal, but not as a dielectric insulation.

From the foregoing, it will be apparent that two corrosion mechanisms are in place when the piping system is placed in service by filling it with water under pressure. These two mechanisms are: (1) the introduction of an electrolyte (water) that by its very nature is corrosive when in contact with ferrous-based materials and (2) activation of the classic dissimilar metals galvanic couple, in this case bronze (or brass) and iron at the sprinkler head/iron tee connection or interface. In addition, sulfate reducing bacteria, SRB's, are invariably introduced to the closed piping system with the water. Since SRB's can only survive and thrive in an anaerobic (airless or oxygen-less) environment the mechanism for corrosion of iron is put in place in this static, oxygen-free, waterborne media. The result is additional corrosion of iron by sulfate reducing bacteria, and the product of this corrosion activity is the stable compound iron sulfide. In fact, when fire protection systems are purged, the effluent is always black water that has the odor of sewer gas and water which is characteristic of iron sulfide. Iron sulfide, being a stable chemical compound, is the source of a sludge buildup that plugs the sprinkler heads and nozzles, thereby eliminating or severely limiting their operating effectiveness.

Heretofore, there have been no attempts other than purging and flushing, repairing leaks, or replacing piping and/or sprinklers to counter or prevent the above-mentioned deleterious effects from occurring. It should be noted that the cost of substituting non-metallic fittings and iron piping using fiberglass reinforced epoxy resins, the only material available with the specified pressure rating, is prohibitively expensive, particularly the fittings from a first cost basis.

An object of the present invention is to provide a new and improved method and means to prevent corrosion and sludge build-up in both existing and new water-filled sprinkler systems for fire protection.

Another object of this invention is to provide new and improved methods and means to reduce, if not eliminate altogether, the need to test or monitor such systems to insure their continuous reliability.

Still another object of this invention is to provide new and improved means and methods to extend greatly the useful operating life of such system.

Another object of the present invention is to provide new and improved methods and means to eliminate any requirement to purge, recharge, or in any way re-enter or re-work such system, whether on a routine periodic scheduled or an unscheduled basis unless the closed static system is opened owing to activation or addition.

SUMMARY OF THE INVENTION

These and other objects are attained in accordance with the concepts of this invention through the provision of unique methods including the step of introducing into the system water a chemical compound that is selected to raise the alkalinity thereof throughout the piping network to a pH range of from 9.5–11 where all electro-chemical activity (corrosion) of iron in a water medium ceases, as well as the action of sulfate reducing bacteria. Further, the galvanic dissimilar metal couple at the bronze sprinkler head/iron service tee connection is eliminated by providing and installing a properly pressure rated steel dielectric coupling at the connection to effectively block the metallic path between the bronze and iron pipe threads. The addition of an insulating coupling is required at each sprinkler head in the system. When the dielectric couplings are added, each sprinkler head and iron service tee is inspected and cleaned or replaced when removed and prior to returning them to service.

DETAILED DESCRIPTION OF PREFERRED EMBODIMENT

The methods and means which are employed to obtain corrosion and sludge prevention in accordance with this invention for fire protection piping and ancillary devices such as sprinkler heads are identical for both new and existing systems with one exception. Existing systems must be purged throughout the complete piping network and flushed to near clear water before the chemical compound/potable water mixing injection and filling operation begins. In addition, all the iron service tees to which the sprinkler heads are connected must be removed, inspected and cleaned or replaced following the piping network purging and cleaning (flushing) operation. Connections between each sprinkler head and its service tee, including the new dielectric couplings in accordance with this invention, then are installed. At this point, both new and existing piping networks are ready to be commissioned, or re-commissioned in the case of existing systems, following completion of the chemical compound injection and water filling operation of the entire piping network.

The typical fire protection sprinkler system includes a piping manifold in the crawl space between floors of a building, or in the attic of other types of buildings, having a plurality of spaced-apart service tees connected therein. The outer end of the manifold is plugged, and the inner end is connected to a supply of water under pressure, usually the potable water supply for the building. A riser or extension nipple is threaded into each tee, and a sprinkler head is screwed onto the lower end of each extension nipple so as to be exposed at the ceiling of a room. The flow passage in the head normally is closed by a fusible plug that quickly melts in response to the heat of a fire in the room so that a profusion of sprays of water are directed downward to extinguish the fire.

In accordance with one aspect of this invention, galvanic corrosion due to contact between dissimilar metals, namely the riser nipple and the brass or bronze sprinkler head, is prevented by the insertion in the riser or extension of a female coupling having a steel outer tube having a threaded plastic sleeve molded or driven inside it. The plastic sleeve is made of nylon or similar material. The coupling has the same pressure rating as the other components of the system. The riser nipple threads into one end of the coupling sleeve, and an all-thread brass nipple threads into the other end thereof and into the sprinkler head base. The plastic material of the sleeve is a dielectric or nonconductive substance and thus blocks the transmission of any currents that could cause galvanic corrosion.

In accordance with another aspect of the present invention, a chemical compound such as sodium hydroxide or sodium meta-hexa-phosphate is injected into the manifold as it is refilled with water in an amount such that the pH is adjusted to a value in the range of from 9.5 to 11, such compounds being non-toxic in such range. With this pH value all electro-chemical corrosion of iron in a water medium ceases, as well as the action of sulfate reducing bacteria which normally are in the water. Thus no iron sulfide sludge is formed in the system over time.

It is highly desirable to continuously inject the chemical compound as the potable water filling operation proceeds to insure a near homogeneous concentration of the compound, thereby assuring that the pH level will be between the desired values of 9.5 and 11 at all points within the piping network, including the base of each of the service tees.

It is also required that the selection and mixing of the dry chemical prior to injection preclude precipitation of the chemical following stabilization of the chemical/potable water filled piping network. Both the pH control and precipitation prevention requirements are addressed by appropriate selection of the above-mentioned chemicals formulated specifically to "buffer" potable water systems with respect to pH control. Likewise, portable mixing and injection equipment can be readily sized and assembled from commercially available off-the-shelf components, to insure continuous pH control throughout the entire piping network.

Testing procedures appropriate to insure a continuous, long term corrosion and sludge free fire protection system include obtaining water samples near or at the injection point, the midpoint, and at the end of piping network following completion of water filling and stabilization. These tests include pH measurements via high resolution indicators and/or suitable electronic instruments specifically designed to obtain accurate measurements and collection of permanent solution samples to study and observe long-term changes in chemical/water separation/precipitation, pH, etc., if any. All measurements and test results should be documented and identified for each fire protection system.

OPERATION

In use of the present invention, each of the connections between a sprinkler head and the pipe manifold includes a dielectric coupling as desired above to prevent corrosion due to galvanic action. Potable water treated with the buffering compound, preferably sodium hydroxide (caustic soda) then is injected into the pipe network of the sprinkler system in a manner such that the pH is in the range of about 9.5–11. Thus all electro-chemical activity is greatly reduced or eliminated altogether. The method basically is passive in nature, as opposed to other forms of corrosion control which are inherently active. Monitoring and maintenance requirements for fire prevention systems in accordance with this invention are virtually nil, e.g., non-existent. About the most that will ever be needed is proper and timely notification should the system's static state change to the dynamic state, e.g., triggered by, in this case, a fire within the structure itself. Monitoring, including pH testing and collecting of test samples at about five year intervals, barring activation, could be prudent, just in case an unreported activation of the system has occurred.

It now will be recognized that a new and improved method and means for preventing corrosion and sludge formation for water filled sprinkler fire protection piping systems has been disclosed.

Since certain changes and modifications may be made in the disclosed embodiment without departing from the inventive concepts involved, it is the aim of the appended claims to cover all such changes and modifications falling within the true spirit and scope of the present invention.

What is claimed is:

1. A method to prevent corrosion and build-up of corrosion products in the piping of a sprinkler system containing water and used for fire protection, comprising the steps of: adding sodium hydroxide to the water to provide a pH value between about 9.5 to 11 which substantially prevents all electro-chemical activity; and installing a plastic-lined metallic tube between each sprinkler head and the piping to prevent galvanic corrosion.

2. The method of claim 1 wherein said installing step includes the installation of a non-conductive pipe fitting including a plastic-lined threaded coupling between each head and the piping.

3. A fire protection system including a plurality of sprinkler heads connected at spaced locations to a pipe manifold containing water and arranged to automatically provide sprays of said water in the event of a fire to extinguish same, comprising: means added to said water to adjust the pH thereof to a level that substantially prevents all electro-chemical corrosion and consequent formation of sludge in said manifold; and non-conductive coupling means communicating each of said sprinkler heads to said manifold to substantially prevent all galvanic corrosion due to contact between dissimilar metals, said non-conductive coupling means including a metallic tube having a threaded plastic sleeve fitted therein.

4. A fire protection system including a plurality of sprinkler heads connected at spaced locations to a pipe manifold containing water and arranged to automatically provide sprays of said water in the event of a fire to extinguish same, comprising: means added to said water to adjust the pH thereof to a level that substantially prevents all electro-chemical corrosion and consequent formation of sludge in said manifold; and non-conductive coupling means communicating each of said sprinkler heads to said manifold to substantially prevent all galvanic corrosion due to contact between dissimilar metals, said non-conductive coupling means including a metallic tube having a dielectric sleeve therein.

5. The system of claim 4 where said plastic is nylon.

* * * * *

UNITED STATES PATENT AND TRADEMARK OFFICE

CERTIFICATE OF CORRECTION

PATENT NO. : 5,803,180
DATED : Sep. 8, 1998
INVENTOR(S) : Talley

It is certified that error appears in the above-identified patent and that said Letters Patent is hereby corrected as shown below:

col. 2, line 46, add the paragraph: --

Brief Description of the Drawing

Figure 1 is a generally schematic view of a fire protection sprinkle system in accord with the present invention -- .

col. 3, line 2, after " manifold " insert -- 10 --.
col. 3, line 4, after " tees " insert -- 12 --.
col. 3, line 8, after " nipple " insert -- 14 -- and after " head " insert -- 16 --.
col. 3, line 14, after " invention " insert – as shown generally in Figure 1 --.
col. 3, line 16, after " nipple " insert -- 14 -- and after " head " insert -- 16 --.
col. 3, line 18, after " coupling " insert -- generally indicated at 18 --.
col. 4, line 4, after " head " insert -- 16 -- and after " manifold " insert -- 10 --.
col. 4, line 5, after " coupling " insert -- 18 --.

Signed and Sealed this

Ninth Day of March, 1999

*Attest:*

Q. TODD DICKINSON

*Attesting Officer*

*Acting Commissioner of Patents and Trademarks*